US008781610B2

(12) United States Patent
Han

(10) Patent No.: US 8,781,610 B2
(45) Date of Patent: Jul. 15, 2014

(54) METHOD OF BALL GAME MOTION RECOGNITION, APPARATUS FOR THE SAME, AND MOTION ASSISTING DEVICE

(75) Inventor: Zheng Han, Beijing (CN)

(73) Assignee: Zepp Labs, Inc., Los Gatos, CA (US)

( * ) Notice: Subject to any disclaimer, the term of this patent is extended or adjusted under 35 U.S.C. 154(b) by 224 days.

(21) Appl. No.: 13/269,216

(22) Filed: Oct. 7, 2011

(65) Prior Publication Data

US 2012/0277890 A1 Nov. 1, 2012

(30) Foreign Application Priority Data

Apr. 29, 2011 (CN) ..... 2011 1 0111602

(51) Int. Cl.
*G06F 19/00* (2011.01)

(52) U.S. Cl.
USPC ..... 700/91; 463/20; 463/25; 463/30

(58) Field of Classification Search
USPC ..... 700/91; 463/20, 25, 30
See application file for complete search history.

(56) References Cited

U.S. PATENT DOCUMENTS

2006/0025998 A1* 2/2006 Sakai et al. ..... 704/260
2007/0219744 A1* 9/2007 Kolen ..... 702/150
2008/0312010 A1* 12/2008 Marty et al. ..... 473/447
2011/0304497 A1* 12/2011 Molyneux et al. ..... 342/42

* cited by examiner

*Primary Examiner* — Paul A D'Agostino
*Assistant Examiner* — Brandon Gray
(74) *Attorney, Agent, or Firm* — Ladas & Parry, LLP

(57) ABSTRACT

The invention provides a method of ball game motion recognition, an apparatus for the same, and a motion assisting device. The method comprises: obtaining motion parameters corresponding to each sampling time for a motion; extracting feature points according to predetermined feature point recognition tactics utilizing the motion parameters obtained, in which the feature point recognition tactics comprise recognition tactics of at least three types of the feature points, comprising: power-assisting path early stage corresponding feature point, motion top point corresponding feature point, and ball hitting time corresponding feature point; and recognizing the motion as a predetermined ball game type if the feature points extracted satisfy feature point requirements of the predetermined ball game type.

28 Claims, 5 Drawing Sheets

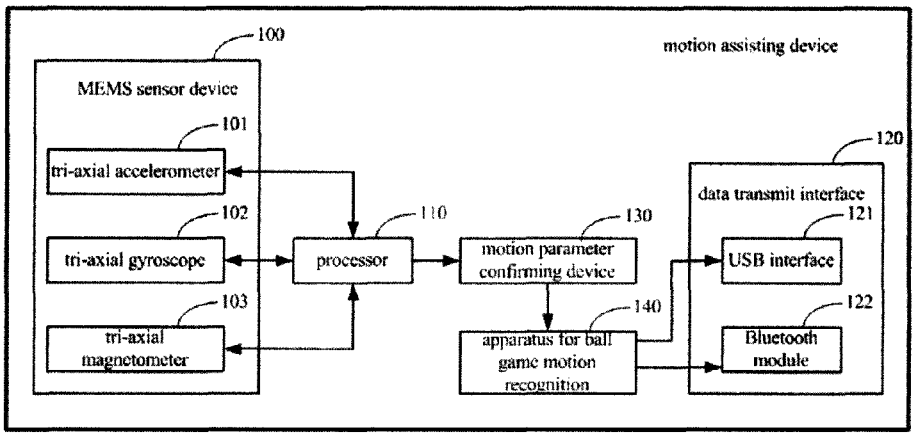
FIG.1b
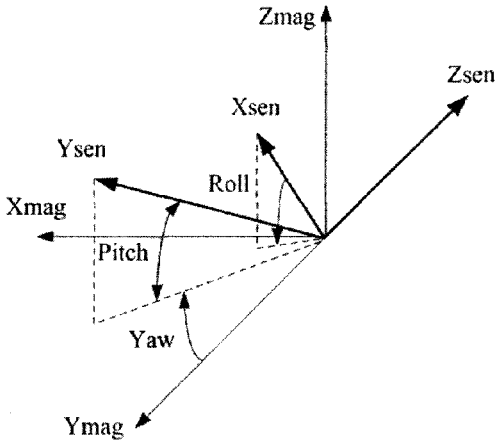
FIG.2
| header field | mark field | motion data sampled by tri-axial magnetometer | motion data sampled by tri-axial accelerometer | motion data sampled by tri-axial gyroscope |
|---|---|---|---|---|
FIG.3

METHOD OF BALL GAME MOTION RECOGNITION, APPARATUS FOR THE SAME, AND MOTION ASSISTING DEVICE

CROSS-REFERENCE TO RELATED APPLICATIONS

This application claims priority to Chinese Patent Application No. 201110111602.0 filed on Apr. 29, 2011, the disclosure of which is incorporated herein by reference.

FIELD OF THE INVENTION

The present invention relates to recognition technology, and particularly to a method of ball game motion recognition, an apparatus for the same, and a motion assisting device.

BACKGROUND

Path and stance recognition for a spatial accelerated motion refers to detecting position and intersection angles at each time in the moving process of an object, and obtaining the real-time velocity of the object. The technique of path and stance recognition for the spatial accelerated motion can be widely applicable in combination to human body action for detection of human body action in areas such as sports, games, movie technology, medical surgery simulation or action skill training.

When motion parameters such as information of acceleration, velocity and position of a moving object are obtained, it is generally required to extract a section of integrated motion and to perform path display or expert evaluation based on the motion parameters of the integrated motion section. Taking golf swing as an example, golf is an outdoor sport requiring high control ability of motions and skills, and either professional golfers or amateur golfers would hope to obtain the motion parameters of the integrated motions of their swings to know the quality of the motions and to further obtain evaluation of the motions.

Generally, the motion parameters obtained in detecting the moving object would include motion parameters for sport motions and other non-sport motions. To conveniently display, analyze or evaluate the sport motions, it is required to recognize a section of sport motion. Again, taking golf swing as an example, the moving object in a golf swing motion can be the golf club or the gloves of the golfer, and in the detecting process of the moving object for obtaining the motion parameters, it is possible that the golfer may do something other than the swing motion, such as drinking water, taking a rest, or picking up a phone call. Thus, there is a need to recognize the swing motion based on the motion parameters.

SUMMARY

The invention provides a method of ball game motion recognition, an apparatus for the same, and a motion assisting device, for recognizing sport motions based on motion parameters.

Specifically, the method of ball game motion recognition provided by the invention comprises:

(A) obtaining motion parameters corresponding to each sampling time for a motion;

(B) extracting feature points according to predetermined feature point recognition tactics utilizing the motion parameters obtained, wherein the feature point recognition tactics comprise recognition tactics of at least three types of the feature points, comprising: power-assisting path early stage corresponding feature point, motion top point corresponding feature point, and ball hitting time corresponding feature point; and (C) recognizing the motion as a predetermined ball game type if the feature points extracted satisfy feature point requirements of the predetermined ball game type.

The method for ball game motion recognition provided by the invention comprises:

a parameter obtaining unit to obtain motion parameters at sampling time for a motion;

a feature point extracting unit to extract feature points according to predetermined feature point recognition tactics utilizing the motion parameters, wherein the feature point recognition tactics comprises recognition tactics of at least three types of the feature points: power-assisting path early stage corresponding feature point, motion top point corresponding feature point, and ball hitting time corresponding feature point; and a motion recognizing unit to recognize the motion as a predetermined ball game type if the feature points extracted satisfy feature point requirements of the predetermined ball game type.

The motion assisting device provided by the invention comprises a sensor device, a motion parameter confirming device, and the aforementioned apparatus for ball game motion recognition.

The sensor device is configured to sample motion data of a recognized object at each of the sampling time, the motion data comprising acceleration; and The motion parameter confirming device is configured to obtain motion parameters of the recognized object corresponding to each sampling time according to motion data sampled by the sensor device, and to send the motion parameters to the apparatus for ball game motion recognition.

According to the disclosed technology, the invention is configured to obtain motion parameters corresponding to each sampling time, and to extract feature points according to predetermined feature point recognition tactics. The predetermined feature point recognition tactics comprise recognition tactics of at least three types of the feature points, comprising: power-assisting path early stage corresponding feature point, motion top point corresponding feature point, and ball hitting time corresponding feature point. Then judgment is made to recognize the motion as a predetermined ball game type if the feature points extracted satisfy feature point requirements of the predetermined ball game type. Thus, the invention can realize recognition and differentiation between sport motions and other non-sport motions.

To improve understanding of the invention, the techniques employed by the present invention to achieve the foregoing objectives, characteristics and effects thereof are described hereinafter by way of examples with reference to the accompanying drawings.

BRIEF DESCRIPTION OF THE DRAWINGS

FIG. 1*b* is a schematic view of the motion assisting device in an embodiment of the invention;

FIG. 2 is a schematic view of an angle output by a tri-axial magnetometer in an embodiment of the invention;

FIG. 3 is a schematic view of the format of a data packet transmitted by a processor in an embodiment of the invention;

DETAILED DESCRIPTION

To achieve the foregoing objectives, technical characteristics and advantages, the techniques employed by the present invention are described hereinafter in detail by way of embodiments with reference to the accompanying drawings.

Figure 1A:
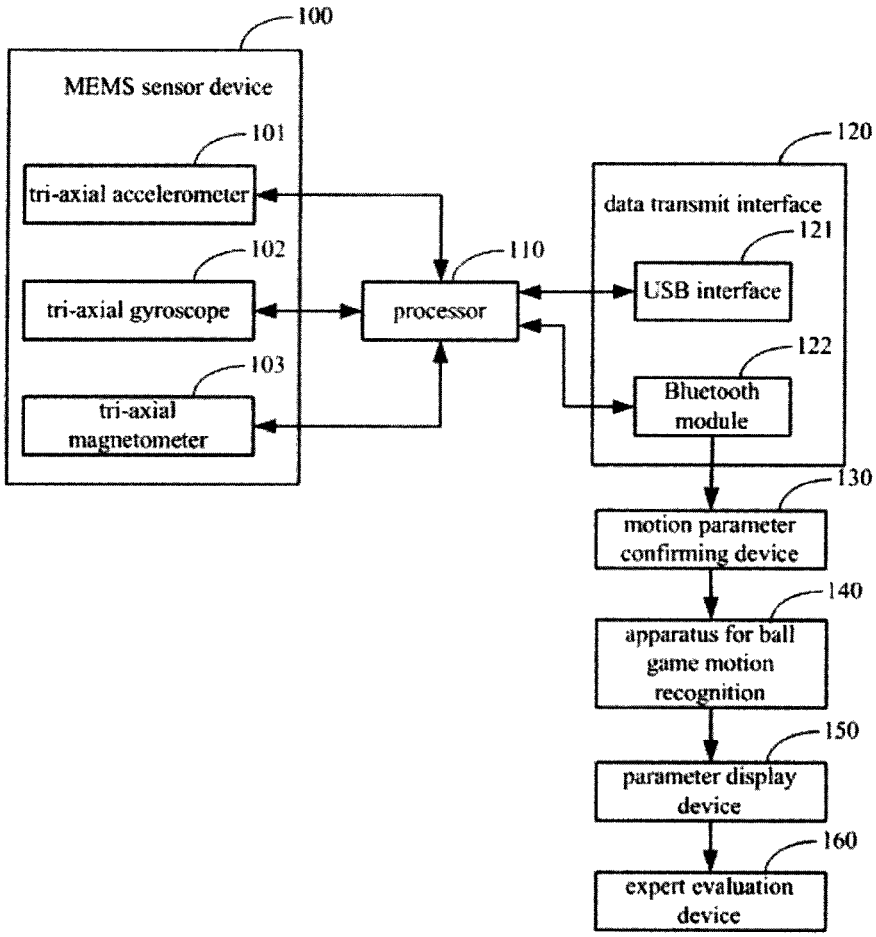
FIG. 1*a* is a schematic view of the structure of the recognition system in an embodiment of the invention.

An embodiment of the invention is shown in FIG. 1*a* as a recognition system, which comprises: a MEMS sensor device 100, a processor 110, data transmit interface 120, and a motion parameter confirming device 130. The recognition system can further comprise: an apparatus for ball game motion recognition 140, a parameter display device 150, and an expert evaluation device 160. The MEMS sensor device 100, the processor 110, and the data transmit interface 120 can be packed as a terminal device provided on the recognized object. For example, in a golf swing motion, the hands of the golfer hold the golf club, and the corresponding positions of the hands and the golf club are fixed. Thus, the positions and stances of the hands correspond to the position and stance of the golf club. Accordingly, the MEMS sensor device 100, the processor 110, and the data transmit interface 120 can be packed as a motion detection device provided on the recognized object, such as the gloves of the golfer or the golf club. Generally, the motion detection device would not be disposed above the wrist of the golfer to ensure the accuracy of the motion detection of the golf swing. The weight of the motion detection device can be dozens of grams and thus ignorable without disturbing the motion of the recognized object.

The MEMS sensor device 100 is configured to sample motion data of the recognized object, the motion data comprising acceleration at each of the sampling time.

The processor 110 is configured to retrieve the motion data from the MEMS sensor device 100 according to certain frequency, and transmit the motion data to the motion parameter confirming device 130 according to predetermined transfer protocol.

Furthermore, the processor 110 can be utilized to receive configuration instructions from the data transmit interface 120, interpret the configuration instructions, configure the MEMS sensor device 100 according to the interpreted data, such as sampling accuracy, sampling frequency and range, and perform calibration of the motion data received. Preferably, the processor 110 can be a low power processor to increase endurance time.

The MEMS sensor device 100 can be connected to the processor 110 by serial bus or AD interface.

The data transmit interface 120 can support wired communication or wireless communication. Wired interface can be protocols such as USB, COM, LPT, or live line, and wireless interface can be Bluetooth or IRDA. In FIG. 1*a*, the data transmit interface 120 of the embodiment has a USB interface 121 and/or a Bluetooth module 122. The USB interface 121 can enable power charge of the terminal device with the MEMS sensor device 100, the processor 110, and the data transmit interface 120 packed together and perform two-way communication to other devices. The Bluetooth module 122 can enable two-way communication from the terminal device to the Bluetooth master device.

The motion parameter confirming device 130, the apparatus for ball game motion recognition 140, the parameter display device 150, and the expert evaluation device 160 can be connected to the processor 110 via the USB interface (not shown in FIG. 1*a*), or can serve as the Bluetooth master device and be connected to the processor 110 via the Bluetooth module 122.

The motion parameter confirming device 130 is configured to confirm motion parameters, such as acceleration information, velocity information, position information, and stance information, according to the motion data received.

The apparatus for ball game motion recognition 140 can be utilized to recognize the type of the motion according to the motion parameters confirmed by the motion parameter confirming device 130, and to extract the motion parameters of the motion of a certain type of sport.

The parameter display device 150 is configured to display the motion parameters confirmed by the motion parameter confirming device 130 in a certain format (the connection is not shown in the figures) or the motion parameters extracted by the apparatus for ball game motion recognition 140 in a certain format, such as showing a three-dimensional path of the position of the recognized object, or velocity information of the recognized object in the format of a table or a line chart. The parameter display device 150 can be any terminal device with display function, such as a computer, a cell phone, or a PDA.

The expert evaluation device 160 is configured to evaluate the motion according to the motion parameters confirmed by the motion parameter confirming device 130 (the connection is not shown in the figures) or the motion parameters extracted by the apparatus for ball game motion recognition 140. The evaluation can be from a real expert or an automated evaluation according to preset motion parameter database.

It should be noted that, in an embodiment, the MEMS sensor device 100, the motion parameter confirming device 130, and the apparatus for ball game motion recognition 140 can be packed as a motion assisting device, as shown in FIG. 1*b*. The motion parameter confirming device 130 can directly obtain the motion data sampled by the MEMS sensor device 100 and confirm the motion parameters of the recognized object at each of the sampling time, and transmit the motion parameters to the apparatus for ball game motion recognition 140 to perform motion recognition.

In the motion assisting device, the processor 110 can also retrieve the motion data from the MEMS sensor device 100 according to a predetermined frequency, and transmit the motion data to the motion parameter confirming device 130 under the transfer protocol.

Furthermore, the data transmit interface 120 can be provided as an interface to connect to the apparatus for ball game motion recognition 140. Similarly, the data transmit interface 120 can also be a USB interface 121 or a Bluetooth module 122. The data transmit interface 120 can transmit the motion parameters recognized by the apparatus for ball game motion recognition 140 to other devices, such as the parameter display device or the expert evaluation device.

Alternatively, the data transmit interface 120 can also be disposed between the processor and the motion parameter confirming device 130 in the way as shown in FIG. 1*a*.

The motion parameter confirming device 130 can utilize a variety of approaches to confirm the motion parameters of the recognized object. Currently, the most utilized motion parameter confirming approaches include, but are not limited to, the following two approaches.

The first approach is performed by the MEMS sensor device formed by IRDA arrays and a tri-axial accelerometer, which can be referred to in the US Patent Publication No. US2008/0119269A1, titled "GAME SYSTEM AND STORAGE MEDIUM STORING GAME PROGRAM." The approach utilizes the tri-axial accelerometer to sample acceleration of the recognized object at each of the sampling time, and provides two infrared generators at both ends of the recognized object to calculate the position on the two-dimensional surface parallel to the surface of the signal receiving terminal according to the signal intensity and the relative distance.

The second approach is disclosed in the US Patent Publication No. US2008/0049102A1, titled "MOTION DETECTION SYSTEM AND METHOD." The approach utilizes the MEMS sensor device formed by an accelerometer and a gyroscope, or by two accelerometers disposed in a fixed interval distance, to obtain full six-dimensional motion parameters (three-dimensional motion and three-dimensional rotation).

In addition to the two motion parameter confirming approaches, the MEMS sensor device 100 as shown in FIG. 1*a* and FIG. 1*b* can also be utilized.

In the embodiment, the MEMS sensor device 100 comprises a tri-axial accelerometer 101, a tri-axial gyroscope 102, and a tri-axial magnetometer 103.

The tri-axial accelerometer 101 is configured to sample acceleration of the recognized object at each sampling time. The acceleration is the three-dimensional acceleration, which includes acceleration along X-axis, Y-axis and Z-axis at each sampling time.

The tri-axial gyroscope 102 is configured to sample angular velocity of the recognized object at each sampling time. Similarly, the angular velocity is the three-dimensional angular velocity, which includes angular velocity along X-axis, Y-axis and Z-axis at each sampling time.

The tri-axial magnetometer 103 is configured to sample the angle of the recognized object corresponding to a three-dimensional geomagnetic coordinate system. At each sampling time, the angle data include: Roll, Yaw and Pitch, in which Roll is the angle between the X-axis of the recognized object and the XY plane of the three-dimensional geomagnetic coordinate system, Yaw is the angle between the projecting vector of the Y-axis of the recognized object onto the XY plane of the three-dimensional geomagnetic coordinate system and the Y-axis of the three-dimensional geomagnetic coordinate system, and Pitch is the angle between the Y-axis of the recognized object and the XY plane of the three-dimensional geomagnetic coordinate system. As shown in FIG. 2, Xmag, Ymag and Zmag are the X-axis, Y-axis and Z-axis of the three-dimensional geomagnetic coordinate system, and Xsen, Ysen and Zsen are the X-axis, Y-axis and Z-axis of the recognized object.

At this time, the processor 110 retrieves motion data sampled by the tri-axial accelerometer 101, the tri-axial gyroscope 102, and the tri-axial magnetometer 103 of the MEMS sensor device 100, and transmit the motion data to the motion parameter confirming device 130 according to predetermined transfer protocol. FIG. 3 shows one format of the data packet of the motion data transmitted by the processor, in which the mark field can include verification information to ensure the completeness and safety of the data, and the header field can include protocol header applied in transmission of the motion data.

Figure 4:
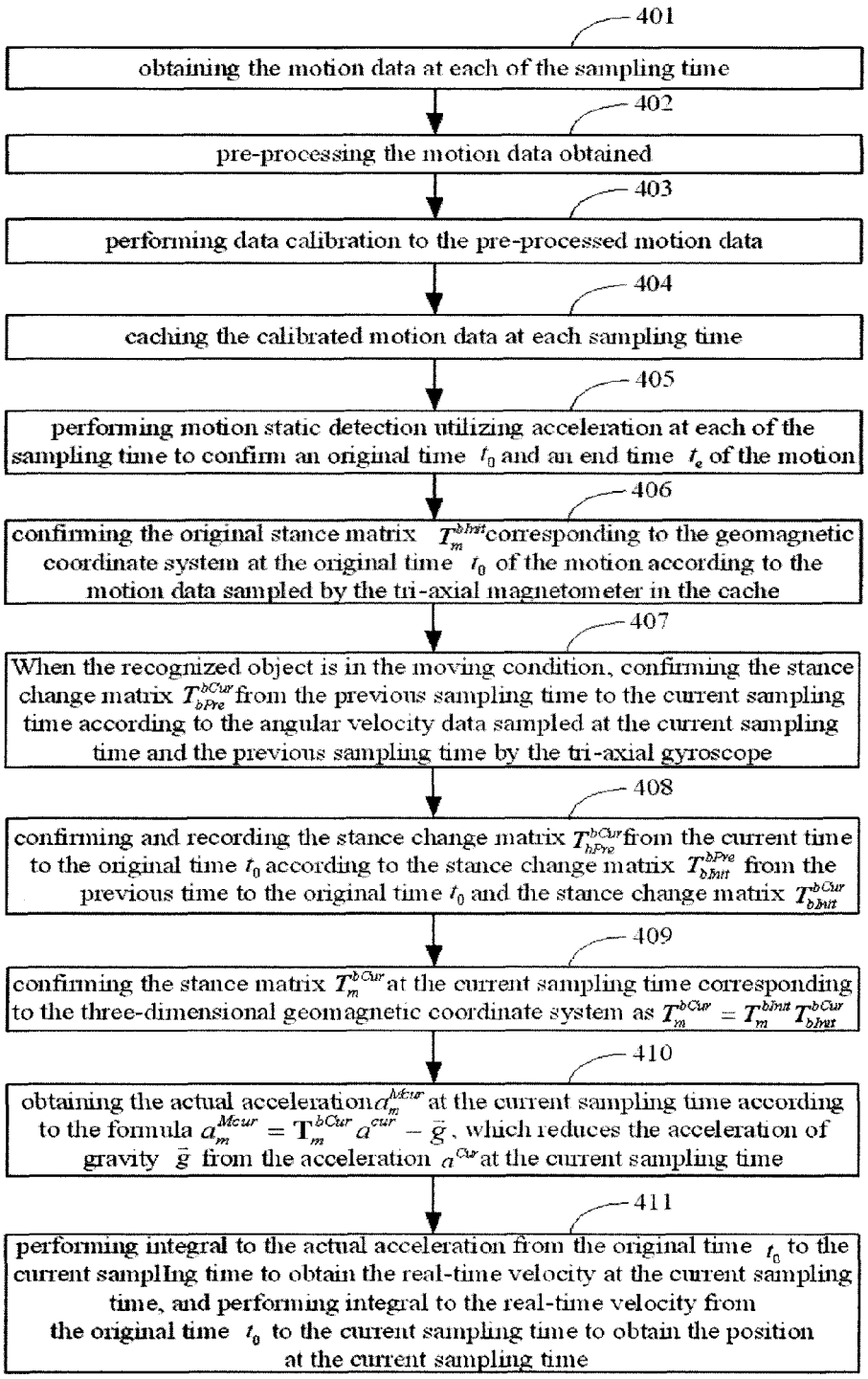
FIG. 4 is a flowchart of the method of confirming motion parameters provided in an embodiment of the invention.

The motion parameter confirming method utilized in the motion parameter confirming device 130 is shown in FIG. 4, which comprises the following steps:

Step 401: obtaining the motion data at each of the sampling time, the motion data includes: the acceleration of the recognized object sampled by the tri-axial accelerometer, the angular velocity of the recognized object sampled by the tri-axial gyroscope, and the angle of the recognized object corresponding to a three-dimensional geomagnetic coordinate system sampled by the tri-axial magnetometer.

In obtaining the motion data at each sampling time, if the sampling frequency of the MEMS sensor device is not high enough, the motion data obtained can be processed by interpolation processing, such as linear interpolation or spline interpolation, to enhance the calculation accuracy of the motion parameters of acceleration, velocity and position.

Step 402: pre-processing the motion data obtained.

The pre-processing of the step is to perform filtering to the motion data to reduce the noise of the motion data sampled by the MEMS sensor device. Various filtering approaches can be utilized. For example, 16 point Fast Fourier Transform (FFT) filtering can be used. The specific approach of filtering is not limited.

The interpolation processing and pre-processing are not necessarily performed in a fixed order. The processing can be performed in any sequence. Alternatively, it is optional to perform only one of the processing.

Step 403: performing data calibration to the pre-processed motion data.

The step mainly performs calibration to the acceleration sampled by the tri-axial accelerometer. The tri-axial accelerometer has a zero drift $\vec{\omega}_0$, and the acceleration obtained at each sampling time is reduced by the zero drift $\vec{\omega}_0$ to obtain the calibrated acceleration at each sampling time. The zero drift $\vec{\omega}_0$ of the tri-axial accelerometer can be obtained by sampling acceleration to a nonmoving object.

The steps 402 and 403 are preferred steps of the embodiment of the invention. However, the steps 402 and 403 can be skipped and the motion data obtained in step 401 can be cached directly.

Step 404: caching the calibrated motion data at each sampling time.

The most recently obtained number N of the motion data is saved to the cache. That is, the cached motion data includes: the motion data at the latest sampling time to the motion data at the earlier N−1 sampling time. The motion data of the earliest sampling time overflows when the motion data of a new sampling time is saved to the cache. Preferably, N can be an integer of 3 or higher, and generally is an integer power of 2, such as 16 or 32 to maintain a caching length of 0.1 s~0.2 s of motion data in the cache. The data structure of the cache is a queue in the order of the sampling time, with the motion data of the latest sampling time at the end of the queue.

Step 405: performing motion static detection utilizing acceleration at each of the sampling time to confirm an original time $t_o$ and an end time $t_e$ of the motion.

The original time $t_o$ is the critical sampling time from the nonmoving condition to the moving condition, and the end time $t_e$ is the critical sampling time from the moving condition to the nonmoving condition.

Judgment is performed according to predetermined motion time confirming tactics to each of the sampling time in sequence of the sampling time. If at the sampling time to the predetermined motion time confirming tactics are satisfied and at the sampling time to−1 the predetermined motion time confirming tactics are not satisfied, the sampling time to is confirmed as the original time. If at the sampling time $t_e$ the predetermined motion time confirming tactics are satisfied and at the sampling time $t_e+1$ the predetermined motion time confirming tactics are not satisfied, the sampling time $t_e$ is confirmed as the end time.

Specifically, the predetermined motion time confirming tactics may comprise: confirming one of the sampling time $t_x$ as motion time if a modulated variance $a_v$ of the acceleration from a number T of the sampling time before the sampling time $t_x$ is larger than or equal to a predetermined acceleration variance threshold and a modulated acceleration $a_0$ at the sampling time $t_x$ is larger than or equal to a predetermined motion acceleration threshold. In other words, if at a certain sampling time the predetermined motion time confirming tactics are satisfied, the sampling time is considered in a moving condition; otherwise it is considered in a nonmoving condition.

The predetermined motion time confirming tactics may effectively filter shock in a short time and prevent from a cutoff of a complete motion by short-term standstill and pause actions. The value of the predetermined acceleration variance threshold and the predetermined motion acceleration threshold can be flexible according to the degree of the motion of the recognized object. When the motion of the recognized object is more violent, the value of the predetermined acceleration variance threshold and the predetermined motion acceleration threshold can be set higher.

The sampling time between the original time $t_o$ and the end time $t_e$ in the cache is treated in sequence as the current sampling time to perform steps 406 to 411.

Step 406: confirming the original stance matrix $T_m^{bInit}$ corresponding to the geomagnetic coordinate system at the original time $t_o$ of the motion according to the motion data sampled by the tri-axial magnetometer in the cache.

$$T_m^{bInit}=[X_{bt_0},Y_{bt_0},Z_{bt_0}] \tag{1}$$

wherein:

$$X_{bt_0}=\begin{bmatrix}\sin(Roll_{t_0})\sin(Yaw_{t_0})\sin(Pitch_{t_0})+\cos(Roll_{t_0})\cos(Yaw_{t_0})\\ \sin(Roll_{t_0})\cos(Yaw_{t_0})\sin(Pitch_{t_0})-\cos(Roll_{t_0})\sin(Yaw_{t_0})\\ -\sin(Roll_{t_0})\cos(Pitch_{t_0})\end{bmatrix}$$

$$Y_{bt_0}=\begin{bmatrix}\cos(Pitch_{t_0})\sin(Yaw_{t_0})\\ \cos(Pitch_{t_0})\cos(Yaw_{t_0})\\ \sin(Pitch_{t_0})\end{bmatrix}, \text{ and}$$

$$Z_{bt_0}=\begin{bmatrix}\sin(Roll_{t_0})\cos(Yaw_{t_0})-\cos(Roll_{t_0})\sin(Yaw_{t_0})\sin(Pitch_{t_0})\\ -\sin(Roll_{t_0})\sin(Yaw_{t_0})-\cos(Roll_{t_0})\cos(Yaw_{t_0})\sin(Pitch_{t_0})\\ \cos(Roll_{t_0})\cos(Pitch_{t_0})\end{bmatrix}$$

$Roll_{t_0}$, $Yaw_{t_0}$ and $Pitch_{t_0}$ are the angles sampled at the sampling time to by the tri-axial magnetometer.

Step 407: when the recognized object is in the moving condition, confirming the stance change matrix $T_{bPre}^{bCur}$ from the previous sampling time to the current sampling time according to the angular velocity data sampled at the current sampling time and the previous sampling time by the tri-axial gyroscope.

Specifically, the angular velocity data sampled by the tri-axial gyroscope at the previous sampling time is $w_P=[\omega_{Px},\omega_{Py},\omega_{Pz}]^T$, and the angular velocity data at the current sampling time is $w_C=[\omega_{Cx},\omega_{Cy},\omega_{Cz}]^T$. The time interval between adjacent sampling time is t, and the stance change matrix $T_{bPre}^{bCur}$ from the previous sampling time to the current sampling time can be confirmed as $T_{bPre}^{bCur}=R_ZR_YR_X$.

$R_Z$, $R_Y$, $R_X$ are the stance change matrices of $w_P$, respectively rotating $(\omega_{Pz}+\omega_{Cz})t/2$, $(\omega_{Py}+\omega_{Cy})t/2$, and $(\omega_{Px}+\omega_{Cx})t/2$ around the Z-axis, Y-axis, and X-axis.

Step 408: confirming and recording the stance change matrix $T_{bInit}^{bCur}$ from the current time to the original time $t_o$ according to the stance change matrix $T_{bInit}^{bPre}$ from the previous time to the original time $t_o$ and the stance change matrix $T_{bPre}^{bCur}$.

In the motion with the original time $t_o$, the stance change matrix from any of the sampling time to the original time $t_o$ will be recorded. Thus, with the stance change matrix $T_{bInit}^{bPre}$ from the previous time retrieved, the stance change matrix $T_{bPre}^{bCur}$ of the current time can be:

$$T_{bInit}^{bCur}=T_{bInit}^{bPre}T_{bPre}^{bCur} \tag{2}$$

Step 409: confirming the stance matrix $T_m^{bCur}$ at the current sampling time corresponding to the three-dimensional geomagnetic coordinate system as $T_m^{bCur}=T_m^{bInit}T_{bInit}^{bCur}$.

According to the steps 407, 408 and 409, the stance matrix $T_m^{bCur}$ at the current sampling time corresponding to the three-dimensional geomagnetic coordinate system is obtained by a "feedback" type of iterative calculation, which is shown as $$T_m^{bCur}=T_m^{bInit}\prod_{x=Init}^{Cur-1}T_{b(x+1)}^{bx}.$$

The terms Cur is the current sampling time, Init is the original time $t_o$, and $T_{b(x+1)}^{bx}$ is the stance change matrix from sampling time x to sampling time x+1.

Step 410: obtaining the actual acceleration $a_m^{Mcur}$ at the current sampling time according to the formula $a_m^{Mcur}=T_m^{bCur}a^{cur}-\vec{g}$, which reduces the acceleration of gravity $\vec{g}$ from the acceleration $a^{Cur}$ at the current sampling time.

The acceleration of gravity $\vec{g}$ of the three-dimensional geomagnetic coordinate system can be obtained by a nonmoving object.

Specifically, the tri-axial accelerometer can be utilized to sample a nonmoving object with M numbers of consecutive sampling time. Thus, the mean value of the acceleration of gravity obtained with the M numbers of consecutive sampling time can be the acceleration of gravity $\vec{g}$ of the three-dimensional geomagnetic coordinate system. The acceleration of gravity $\vec{g}$ can be confirmed according to formula (3):

$$\vec{g}=\frac{1}{M}\sum_{j=i}^{i+M}\vec{a}_{mj} \tag{3}$$

wherein:

M is a predetermined positive integer, i is the original sampling time for sampling of the nonmoving object, and $$\vec{a}_{mj}=T_{mj}^{b}\vec{a}_{bj} \tag{4}$$

$\vec{a}_{bj}$ is the acceleration sampled by the tri-axial accelerometer at the sampling time j, and $T_{mj}^{b}$ is the stance matrix of the nonmoving object at the sampling time j. According to the angle confirmed by the trial-axial accelerometer at the sampling time j, $T_{mj}^{b}$ is:

$$T_{mj}^{b}=[X_{bj},Y_{bj},Z_{bj}] \tag{5}$$

wherein:

$$X_{bj} = \begin{bmatrix} \sin(Roll_j)\sin(Yaw_j)\sin(Pitch_j) + \cos(Roll_j)\cos(Yaw_j) \\ \sin(Roll_j)\cos(Yaw_j)\sin(Pitch_j) - \cos(Roll_j)\sin(Yaw_j) \\ -\sin(Roll_j)\cos(Pitch_j) \end{bmatrix}$$

$$Y_{bj} = \begin{bmatrix} \cos(Pitch_j)\sin(Yaw_j) \\ \cos(Pitch_j)\cos(Yaw_j) \\ \sin(Pitch_j) \end{bmatrix}, \text{ and}$$

$$Z_{bj} = \begin{bmatrix} \sin(Roll_j)\cos(Yaw_j) - \cos(Roll_j)\sin(Yaw_j)\sin(Pitch_j) \\ -\sin(Roll_j)\sin(Yaw_j) - \cos(Roll_j)\cos(Yaw_j)\sin(Pitch_j) \\ \cos(Roll_j)\cos(Pitch_j) \end{bmatrix}$$

$Roll_j$, $Yaw_j$ and $Pitch_j$ are the angles sampled at the sampling time j by the tri-axial magnetometer.

Step 411: performing integral to the actual acceleration from the original time $t_o$ to the current sampling time to obtain the real-time velocity at the current sampling time, and performing integral to the real-time velocity from the original time $t_o$ to the current sampling time to obtain the position at the current sampling time.

The technique to obtain real-time velocity and position in the step is well-known, and description of the technique will be hereafter omitted.

Thus, at least one of the acceleration, real-time velocity and position between the original time $t_o$ and the end time $t_e$ can be saved in the database as the motion parameters of the motion.

In the aforementioned process, if the time interval between the end time of a motion and the original time of a next motion is shorter than a predetermined time period threshold, the two separate motions would be considered one continuous motion, and "connecting" of the motions must be performed. That is, if the time interval between the original time $t_o$ confirmed by the step 405 and the end time t' of the previous motion is shorter than the predetermined time period threshold, the stance matrix of t' serves as the original stance matrix $T_m^{bInit}$ at the original time $t_o$. Otherwise, the original stance matrix $T_m^{bInit}$ at the original time $t_o$ is confirmed according to formula (1).

The method of motion recognition performed by the apparatus for ball game motion recognition 140 in FIG. 1 can be hereafter described in detail. The method comprises the following steps:

Step 501: obtaining the motion parameters at each of the sampling time.

The motion parameters obtained in the step can comprise: acceleration, velocity, stance and position at each sampling time. The motion parameters are obtained from the motion parameter confirming device 130.

Step 502: performing motion static detection utilizing acceleration at each of the sampling time to confirm an original time $t_o$ and an end time $t_e$ of the motion.

The original time $t_o$ is the critical sampling time from the nonmoving condition to the moving condition, and the end time $t_e$ is the critical sampling time from the moving condition to the nonmoving condition.

Judgment is performed according to predetermined motion time confirming tactics to each of the sampling time in sequence of the sampling time. If at the sampling time to the predetermined motion time confirming tactics are satisfied and at the sampling time to−1 the predetermined motion time confirming tactics are not satisfied, the sampling time to is confirmed as the original time. If at the sampling time $t_e$ the predetermined motion time confirming tactics are satisfied and at the sampling time $t_e$+1 the predetermined motion time confirming tactics are not satisfied, the sampling time $t_e$ is confirmed as the end time.

Specifically, the predetermined motion time confirming tactics may comprise: confirming one of the sampling time $t_x$ as motion time if a modulated variance $a_v$ of the acceleration from a number T of the sampling time before the sampling time $t_x$ is larger than or equal to a predetermined acceleration variance threshold and a modulated acceleration $a_0$ at the sampling time $t_x$ is larger than or equal to a predetermined motion acceleration threshold. T is a predetermined positive integer. In other words, if at a certain sampling time the predetermined motion time confirming tactics are satisfied, the sampling time is considered in a moving condition; otherwise it is considered in a nonmoving condition.

The predetermined motion time confirming tactics may effectively filter shock in a short time and prevent from a cutoff of a complete motion by short-term standstill and pause actions. The value of the predetermined acceleration variance threshold and the predetermined motion acceleration threshold can be flexible according to the degree of the motion of the recognized object. When the motion of the recognized object is more violent, the value of the predetermined acceleration variance threshold and the predetermined motion acceleration threshold can be set higher.

Please note that the step 502 is unnecessary if the motion parameters obtained are the motion parameters of the motion, i.e. the MEMS sensor device obtains motion data from the start of the motion to the end of the motion, or the motion parameter confirming device has confirmed the original time $t_o$ and the end time $t_e$ of the motion. In this case, the original time is the first sampling time, and the end time is the last sampling time.

Step 503: extracting feature points from the original time $t_o$ according to predetermined feature point recognition tactics utilizing the motion parameters obtained.

For each predetermined type of sport, a set of the predetermined feature point recognition tactics can be provided to recognize multiple feature points. Different feature points correspond to different feature point recognition tactics.

Taking golf swing as an example, a golf swing motion comprises three major components: back swing, down swing, and follow through after impact. Each of the major components affects the impact. In a detailed way, seven feature points exist in the golf swing motion: static aiming at the original time, take back, up swing, top swing, temporary standstill or direct down swing, impact, and follow through after impact. All of the seven feature points must exist in the aforementioned order. If all of the seven feature points are recognized in the aforementioned order between the original time $t_o$ and the end time $t_e$ from a set of motion parameters, the motion can be confirmed as a golf swing motion.

Each of the feature points must be recognized according to the corresponding feature point recognition tactics. Specifically, the respective feature point recognition tactics can be shown as follows:

Recognition tactic of feature point one: velocity being 0. The feature point one corresponds to static aiming at the original time.

Recognition tactic of feature point two: feature point two is recognized if both ratios of velocity in a horizontal dimension to velocity in the other two dimensions are larger than a predetermined feature point two ratio. The predetermined feature point two ratio can be a value of experience or an experimental value, and can be preferably a ratio of 4 or higher. If the golfer is right-handed, the velocity in the horizontal dimension is toward the right direction, and if the golfer is left-handed, the velocity in the horizontal dimension is toward the left direction. The feature point two corresponds to take back, in which the golf club is swung to a substantially horizontal position.

The two other dimensions mentioned in the recognition tactic of feature point two are the vertical dimension and the third dimension perpendicular to the horizontal and vertical dimension.

Recognition tactic of feature point three: feature point three is recognized if both ratios of velocity in a first direction of the vertical dimension to velocity in the other two dimensions are larger than a predetermined feature point three ratio. The predetermined feature point three ratio can be a value of experience or an experimental value, and can be preferably a ratio of 4 or higher. The feature point three corresponds to up swing, in which the golf club is swung to a substantially vertical position perpendicular to the ground.

The two other dimensions mentioned in the recognition tactic of feature point three are the horizontal dimension and the third dimension perpendicular to the horizontal and vertical dimension.

Recognition tactic of feature point four: feature point four is recognized if velocity in the vertical dimension is smaller than a predetermined feature point four velocity threshold. Preferably, the recognition tactics can be expanded that the feature point four is recognized if velocity in the vertical dimension is smaller than a predetermined feature point four velocity threshold and the height and acceleration satisfy predetermined feature point four requirements. Preferably, the feature point four velocity threshold can be a value of 0.1 m/s or lower, and the predetermined feature point four requirements can be: height being 0.5 m or higher, and acceleration being 0.1 $m/s^2$ or higher. The feature point four corresponds to top swing, in which the velocity in the vertical dimension is substantially zero, and the height and stance of the hands are under certain limitation.

It should be noted that, at the top swing of the feature point four, a temporary standstill interval can exist such that the motion is misjudged to be at its end. To prevent the misjudgment from occurring, if the end time $t_e$ and the original time of a next motion are between a first predetermined feature point and a second predetermined feature point, the end time $t_e$ and an original time of the next motion are ignored, and the motion and the next motion are recognized as one continuous motion, and the motion parameters between the original time $t_o$ and an end time of the next motion are confirmed as the motion. In the golf swing motion, the first predetermined feature point is the feature point four, and the second predetermined feature point is the feature point five.

Recognition tactic of feature point five: feature point five is recognized if both ratios of velocity in a second direction of the vertical dimension to velocity in the other two dimensions are larger than a predetermined feature point five ratio, in which the first direction is opposite to the second direction, and the predetermined feature point five ratio is larger than the predetermined feature point three ratio. The predetermined feature point five ratio can be a value of experience or an experimental value, and can be preferably a ratio of 8 or higher. The feature point five corresponds to down swing, which is similar to up swing, but the velocity of the motion is larger and the direction of the motion is in the opposite.

The two other dimensions mentioned in the recognition tactic of feature point five are the horizontal dimension and the third dimension perpendicular to the horizontal and vertical dimension.

Recognition tactic of feature point six: the feature point six can be explained in two different types of actions. In the first type of action the golfer performs a practice swing, which is a swing that does not hit the ball. In an ideal swing of the golf swing motion, the path of the down swing overlaps the path of up swing, but the velocity of the down swing is larger. This ideal swing path ensures the stance of the golf club to be the same at the time of impact and at the time of static aiming at the original time to generate the best ball hitting direction. Thus, in a practice swing, the best impact point is the closest point to the position of the static aiming at the original time. In the second type of action the golfer performs an actual swing to hit the ball, and at the time of the impact, the impact between the club and the golf ball in high speed creates shock to the acceleration.

In the first type of action, the recognition tactic of feature point six comprises: if, at the sampling time t, a value of $\min(\alpha\|X_t-X_{init}\|+\beta\|T_t-T_{init}\|)$ is smaller than a predetermined feature point six threshold, the feature point six is recognized. $X_t$ is a position corresponding to the sampling time t, $X_{init}$ is a position corresponding to an original time $t_o$ of the motion, $T_t$ is a stance corresponding to the sampling time t, and $T_{init}$ is a stance corresponding to the original time $t_o$ of the motion. $\alpha$ and $\beta$ are predetermined parameters, and can be, for example, 0.5 and 0.5. The predetermined feature point six threshold can be a value of experience or an experimental value, and can be preferably a ratio of 8 or higher.

$T_{init}$ and $T_t$ correspond respectively to the rotation of the recognized object at the sampling time $t_o$ and t.

If the MEMS sensor device in FIG. 1 is used to sample motion data for confirming the motion parameters, $T_{init}$ can be an original stance matrix corresponding to the three-dimensional geomagnetic coordinate system at the original time $t_o$. $T_t$ can be an original stance matrix corresponding to the three-dimensional geomagnetic coordinate system at the sampling time t.

$$T_{init}=[X_{t_0}, Y_{t_0}, Z_{t_0}],$$

wherein:

$$X_{t_0} = \begin{bmatrix} \sin(Roll_{t_0})\sin(Yaw_{t_0})\sin(Pitch_{t_0}) + \cos(Roll_{t_0})\cos(Yaw_{t_0}) \\ \sin(Roll_{t_0})\cos(Yaw_{t_0})\sin(Pitch_{t_0}) - \cos(Roll_{t_0})\sin(Yaw_{t_0}) \\ -\sin(Roll_{t_0})\cos(Pitch_{t_0}) \end{bmatrix}$$

$$Y_{t_0} = \begin{bmatrix} \cos(Pitch_{t_0})\sin(Yaw_{t_0}) \\ \cos(Pitch_{t_0})\cos(Yaw_{t_0}) \\ \sin(Pitch_{t_0}) \end{bmatrix}, \text{ and}$$

$$Z_{t_0} = \begin{bmatrix} \sin(Roll_{t_0})\cos(Yaw_{t_0}) - \cos(Roll_{t_0})\sin(Yaw_{t_0})\sin(Pitch_{t_0}) \\ -\sin(Roll_{t_0})\sin(Yaw_{t_0}) - \cos(Roll_{t_0})\cos(Yaw_{t_0})\sin(Pitch_{t_0}) \\ \cos(Roll_{t_0})\cos(Pitch_{t_0}) \end{bmatrix}$$

$Roll_{t_0}$, $Yaw_{t_0}$ and $Pitch_{t_0}$ are the angles sampled at the sampling time t by the tri-axial magnetometer.

$$T_t=[X_t, Y_t, Z_t],$$

wherein:

$$X_t = \begin{bmatrix} \sin(Roll_t)\sin(Yaw_t)\sin(Pitch_t) + \cos(Roll_t)\cos(Yaw_t) \\ \sin(Roll_t)\cos(Yaw_t)\sin(Pitch_t) - \cos(Roll_t)\sin(Yaw_t) \\ -\sin(Roll_t)\cos(Pitch_t) \end{bmatrix}$$

-continued $$Y_t = \begin{bmatrix} \cos(Pitch_t)\sin(Yaw_t) \\ \cos(Pitch_t)\cos(Yaw_t) \\ \sin(Pitch_t) \end{bmatrix}, \text{ and}$$

$$Z_t = \begin{bmatrix} \sin(Roll_t)\cos(Yaw_t) - \cos(Roll_t)\sin(Yaw_t)\sin(Pitch_t) \\ -\sin(Roll_t)\sin(Yaw_t) - \cos(Roll_t)\cos(Yaw_t)\sin(Pitch_t) \\ \cos(Roll_t)\cos(Pitch_t) \end{bmatrix}$$

$Roll_t$, $Yaw_t$ and $Pitch_t$ are the angles sampled at the sampling time t by the tri-axial magnetometer.

In the second type of action, the recognition tactic of feature point six comprises: if, at the sampling time, an acceleration change rate is larger than a predetermined feature point six acceleration change rate threshold, the feature point six is recognized. This type of action corresponds to the ball hitting action. Preferably, in a golf swing motion, the angular velocity change rate at the impact changes violently, so the angular velocity change rate at one of the sampling time would be larger than the predetermined feature point six angular velocity change rate threshold. Preferably, the predetermined feature point six acceleration change rate threshold and the predetermined feature point six angular velocity change rate threshold can be values of experience or experimental values, and can be preferably thresholds of 10 $m/s^2$ and 10000°/$s^2$ or higher.

Recognition tactic of feature point seven: velocity being 0.

It should be noted that, in addition to golf swing, other ball games can be analyzed to have the respective feature points. The feature points are obtained according to corresponding paths of the motions, and similarities exist in the motions that two paths having the opposite direction would overlap each other. One of the paths is the power-assisting path for preparation of hitting the ball, which generally goes from the lowest point of the motion to the highest point of the motion. The other of the paths is the ball hitting path, which generally goes from the highest point of the motion to the lowest point of the motion to hit the ball. Examples include soccer, volleyball, and badminton.

In the motion of such ball games, three feature points are the more important ones, including: power-assisting path early stage corresponding feature point, motion top point corresponding feature point, and ball hitting time corresponding feature point.

The recognition tactics of the power-assisting path early stage corresponding feature point comprise: both ratios of velocity in a first dimension to velocity in the other two dimensions being larger than a predetermined power-assisting path early stage corresponding feature point ratio.

The recognition tactics of the motion top point corresponding feature point comprise: velocity in a second dimension being smaller than a predetermined motion top point corresponding feature point velocity threshold, and the height and acceleration satisfying the predetermined motion top point requirement.

The recognition tactics of the ball hitting time corresponding feature point comprise: recognizing the ball hitting time corresponding feature point if, at the sampling time t, a value of $\min(\alpha\|X_t-X_{init}\|+\beta\|T_t-T_{init}\|)$ is smaller than a predetermined ball hitting time corresponding feature point threshold (corresponding to the simulation practice and not to actual ball hitting), wherein $\alpha$ and $\beta$ are predetermined parameters, $X_t$ is a position corresponding to the sampling time t, $X_{init}$ is a position corresponding to an original time $t_o$ of the motion, $T_t$ is a stance corresponding to the sampling time t, and $T_{init}$ is a stance corresponding to the original time $t_o$ of the motion; and recognizing the ball hitting time corresponding feature point if, at the sampling time, an acceleration change rate is larger than a predetermined ball hitting time acceleration change rate threshold (corresponding to the actual ball hitting).

In the example of the aforementioned golf swing, the feature point two corresponds to the power-assisting path early stage corresponding feature point, the feature point four corresponds to the motion top point corresponding feature point, and the feature point six corresponds to ball hitting time corresponding feature point.

Figure 6A:
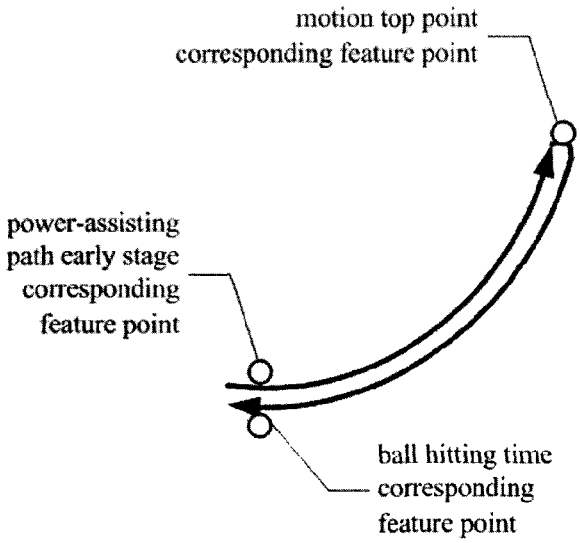
FIG. 6*a* is a schematic view of the paths of golf swing and soccer motion in an embodiment of the invention.

Taking soccer as an example, the motion to kick the soccer ball has the components of lifting the leg backwards, reaching the top point, and kicking the ball. The original time of lifting the leg backwards corresponds to the power-assisting path early stage corresponding feature point, in which the first dimension is a horizontal dimension. Reaching the top point corresponds to the motion top point corresponding feature point, in which the second dimension is a vertical dimension. Kicking the ball (kicking practice or actual kicking of the ball) corresponds to ball hitting time corresponding feature point. The soccer motion is similar to the golf swing motion, as shown in FIG. 6*a*, but the threshold values of the corresponding feature points should be otherwise determined according to the nature of the soccer kicking.

Figure 6B:
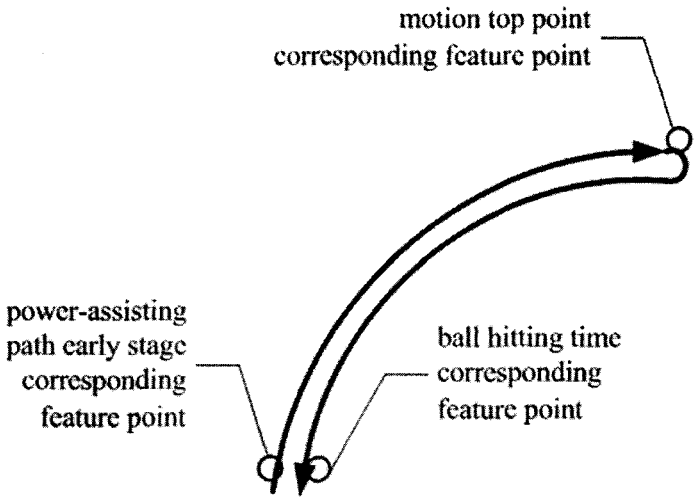
FIG. 6*b* is a schematic view of the path of badminton motion in an embodiment of the invention.

Taking badminton as another example, the motion also has the components of raising the racket, reaching the top point, and swinging the racket. The time of raising the racket corresponds to the power-assisting path early stage corresponding feature point, in which the first dimension is a vertical dimension. Reaching the top point corresponds to the motion top point corresponding feature point, in which the second dimension is a horizontal dimension. Swinging the racket corresponds to ball hitting time corresponding feature point. The badminton motion is shown in FIG. 6*b*, and the threshold values of the corresponding feature points should also be otherwise determined according to the nature of the badminton swinging. Volleyball is another example similar to badminton.

It should be noted that in the motions of various sports, additional feature points other than the three aforementioned feature points may exist. That is, recognition tactics of these additional feature points may exist, and should be determined according to the nature of the sports. Thus, descriptions of these additional recognition tactics are hereafter omitted.

Step 504: recognizing the motion as a predetermined ball game type if the feature points extracted satisfy feature point requirements of the predetermined ball game type.

The feature point requirements of the predetermined ball game type may comprise but should not limited to the following requirements:

The first type of requirements comprises: the feature points extracted satisfying predetermined sequence and number requirement.

Generally, the feature points of a motion must be in a specific order. For example, the aforementioned golf swing requires the seven feature points showing in the sequence from the feature point one to the feature point seven. If the feature points extracted in sequence are a feature point two, a feature point three, a feature point six and a feature point seven, the predetermined sequence is satisfied. However, if the feature points extracted in sequence are a feature point two, a feature point three, a feature point seven and a feature point six, the predetermined sequence is not satisfied.

The number requirement refers to a number of the feature points extracted to recognize the motion as the predetermined ball game type. For example, in the aforementioned golf swing, all of the seven feature points can be required to ensure high accuracy of the motion recognition, which means all seven feature points must be extracted in sequence to recognize the motion as a golf swing motion. However, the swing of every golfer differs due to the habit and skill accuracy of the golfer, and it is acceptable to recognize a golf swing motion without requiring all seven of the aforementioned feature points to be extracted. According to verification of experiments, if four of the seven feature points are satisfied, the golf swing can be recognized. Thus, the number requirement N can be between four and seven.

The first type of requirements comprises: the feature points extracted satisfying predetermined sequence, and grading to the motion according to predetermined weight values corresponding to the feature points extracted satisfying a predetermined grade requirement.

In this case, each of the feature points can be given a predetermined weight value, and a total grading value can be obtained according to the weight values of the feature points extracted. If the total grading value reaches the predetermined grade requirement, the motion is recognized as the predetermined ball game type.

Referring to the description of the step 503, the three common feature points of the ball game sports are the power-assisting path early stage corresponding feature point, the motion top point corresponding feature point, and the ball hitting time corresponding feature point. Thus, these three feature points can be given higher weight values such that a motion can be recognized as the predetermined ball game type if these three feature points are extracted. In the example of golf swing, if the predetermined grade requirement is 6, the weight values of the feature points two, four and six can be set as 2, and the weight values of the other four feature points can be set as 1. Thus, if the feature point two, the feature point four and the feature point six are extracted, the predetermined grade requirement can be satisfied. Alternatively, if the feature point one, the feature point four, the feature point five and the feature point six are extracted, the predetermined grade requirement can also be satisfied to recognize the motion as golf swing.

Figure 5:
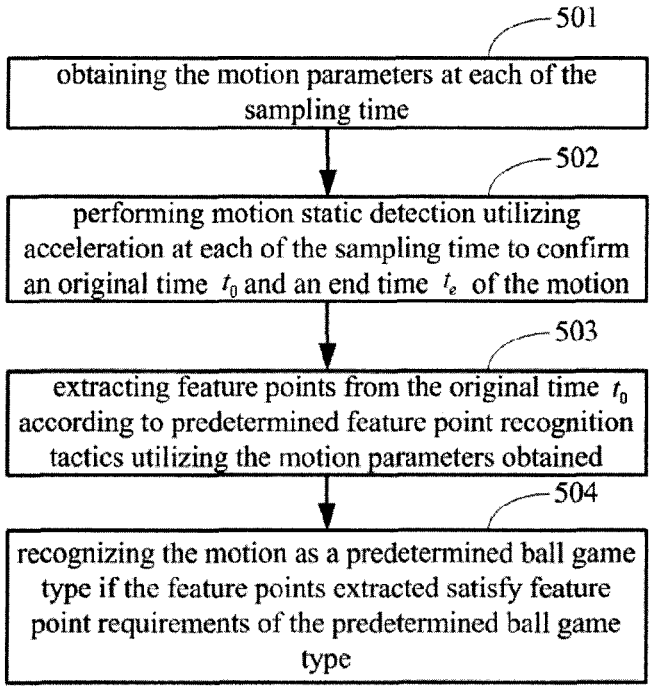
FIG. 5 is a flowchart of the method of motion recognition in an embodiment of the invention.
Figure 7:
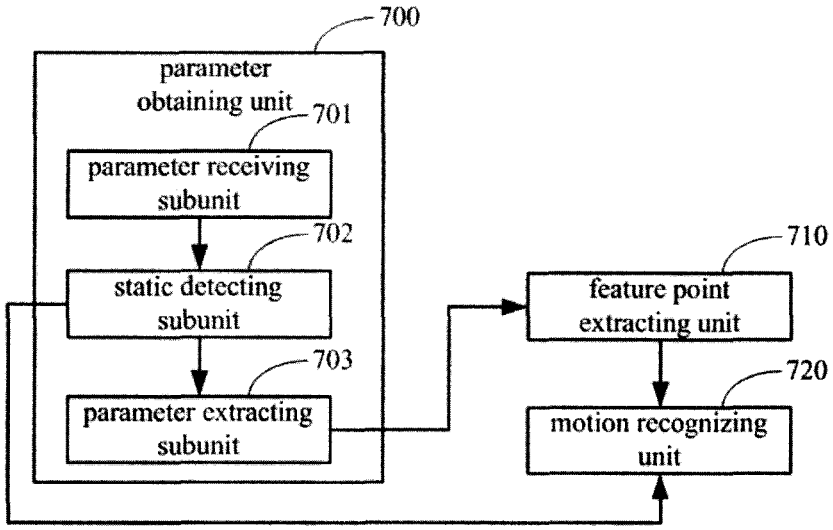
FIG. 7 is a schematic view of the structure of the apparatus for motion recognition in an embodiment of the invention.

The apparatus for motion recognition corresponding to the method in FIG. 5 can be hereafter described in detail. As shown in FIG. 7, the apparatus comprises: a parameter obtaining unit 700, a feature point extracting unit 710, and a motion recognizing unit 720.

The parameter obtaining unit 700 is configured to obtain motion parameters at sampling time for a motion.

The feature point extracting unit 710 is configured to extract feature points according to predetermined feature point recognition tactics utilizing the motion parameters obtained by the parameter obtaining unit 700. The three common feature points of the ball game sports are the power-assisting path early stage corresponding feature point, the motion top point corresponding feature point, and the ball hitting time corresponding feature point. Thus, the feature point recognition tactics comprises recognition tactics of at least three types of the feature points: the power-assisting path early stage corresponding feature point, the motion top point corresponding feature point, and the ball hitting time corresponding feature point.

The motion recognizing unit 720 is configured to recognize the motion as a predetermined ball game type if the feature points extracted by the feature point extracting unit 710 satisfy feature point requirements of the predetermined ball game type.

The apparatus for motion recognition in FIG. 7 can be connected to a motion parameter confirming device, and the parameter obtaining unit 700 is configured to obtain motion parameters corresponding to each sampling time from the motion parameter confirming device.

The motion parameter confirming device is configured to obtain motion parameters corresponding to each sampling time according to motion data sampled at each of the sampling time by the MEMS sensor device, and the motion parameters comprise acceleration, velocity, stance and position.

The MEMS sensor device comprises a tri-axial accelerometer, a tri-axial gyroscope, and a tri-axial magnetometer.

Specifically, the parameter obtaining unit can further comprise: a parameter receiving subunit 701, a static detecting subunit 702, and a parameter extracting subunit 703.

The parameter receiving subunit 701 is configured to obtain the motion parameters at each of the sampling time.

The static detecting subunit 702 is configured to perform motion static detection utilizing acceleration at each of the sampling time to confirm an original time $t_o$ and an end time $t_e$ of the motion Specifically, the static detecting subunit 702 is configured to perform judgment according to predetermined motion time confirming tactics to each of the sampling time in sequence of the sampling time. If at the sampling time $t_o$ the predetermined motion time confirming tactics are satisfied and at the sampling time $t_o-1$ the predetermined motion time confirming tactics are not satisfied, the sampling time $t_o$ is confirmed as the original time. If at the sampling time $t_e$ the predetermined motion time confirming tactics are satisfied and at the sampling time $t_e+1$ the predetermined motion time confirming tactics are not satisfied, the sampling time $t_e$ is confirmed as the end time.

The predetermined motion time confirming tactics may comprise: confirming one of the sampling time $t_x$ as motion time if a modulated variance $a_v$ of the acceleration from a number T of the sampling time before the sampling time $t_x$ is larger than or equal to a predetermined acceleration variance threshold and a modulated acceleration $a_0$ at the sampling time $t_x$ is larger than or equal to a predetermined motion acceleration threshold. The number T is a predetermined positive integer.

The parameter extracting subunit 703 is configured to confirm the motion parameters from the original time $t_o$ to the end time $t_e$.

The recognition tactics of the power-assisting path early stage corresponding feature point comprise: both ratios of velocity in a first dimension to velocity in the other two dimensions being larger than a predetermined power-assisting path early stage corresponding feature point ratio.

The recognition tactics of the motion top point corresponding feature point comprise: velocity in a second dimension being smaller than a predetermined motion top point corresponding feature point velocity threshold.

The recognition tactics of the ball hitting time corresponding feature point comprise: recognizing the ball hitting time corresponding feature point if, at the sampling time t, a value of $\min(\alpha\|X_t-X_{init}\|+\beta\|T_t-T_{init}\|)$ is smaller than a predetermined ball hitting time corresponding feature point threshold, wherein $\alpha$ and $\beta$ are predetermined parameters, $X_t$ is a position corresponding to the sampling time t, $X_{init}$ is a position corresponding to an original time $t_o$ of the motion, $T_t$ is a stance corresponding to the sampling time t, and $T_{init}$ is a stance corresponding to the original time $t_o$ of the motion; and recognizing the ball hitting time corresponding feature point if, at the sampling time, an acceleration change rate is larger than a predetermined ball hitting time acceleration change rate threshold, $$T_{init}=[X_{t_0},Y_{t_0},Z_{t_0}]$$

wherein:

$$X_{t_0}=\begin{bmatrix}\sin(Roll_{t_0})\sin(Yaw_{t_0})\sin(Pitch_{t_0})+\cos(Roll_{t_0})\cos(Yaw_{t_0})\\ \sin(Roll_{t_0})\cos(Yaw_{t_0})\sin(Pitch_{t_0})-\cos(Roll_{t_0})\sin(Yaw_{t_0})\\ -\sin(Roll_{t_0})\cos(Pitch_{t_0})\end{bmatrix}$$

$$Y_{t_0}=\begin{bmatrix}\cos(Pitch_{t_0})\sin(Yaw_{t_0})\\ \cos(Pitch_{t_0})\cos(Yaw_{t_0})\\ \sin(Pitch_{t_0})\end{bmatrix},\text{ and}$$

$$Z_{t_0}=\begin{bmatrix}\sin(Roll_{t_0})\cos(Yaw_{t_0})-\cos(Roll_{t_0})\sin(Yaw_{t_0})\sin(Pitch_{t_0})\\ -\sin(Roll_{t_0})\sin(Yaw_{t_0})-\cos(Roll_{t_0})\cos(Yaw_{t_0})\sin(Pitch_{t_0})\\ \cos(Roll_{t_0})\cos(Pitch_{t_0})\end{bmatrix}$$

$Roll_{t_0}$, $Yaw_{t_0}$ and $Pitch_{t_0}$ are the angles sampled at the sampling time to by the tri-axial magnetometer.

$$T_t=[X_t,Y_t,Z_t],$$

wherein:

$$X_t=\begin{bmatrix}\sin(Roll_t)\sin(Yaw_t)\sin(Pitch_t)+\cos(Roll_t)\cos(Yaw_t)\\ \sin(Roll_t)\cos(Yaw_t)\sin(Pitch_t)-\cos(Roll_t)\sin(Yaw_t)\\ -\sin(Roll_t)\cos(Pitch_t)\end{bmatrix}$$

$$Y_t=\begin{bmatrix}\cos(Pitch_t)\sin(Yaw_t)\\ \cos(Pitch_t)\cos(Yaw_t)\\ \sin(Pitch_t)\end{bmatrix},\text{ and}$$

$$Z_t=\begin{bmatrix}\sin(Roll_t)\cos(Yaw_t)-\cos(Roll_t)\sin(Yaw_t)\sin(Pitch_t)\\ -\sin(Roll_t)\sin(Yaw_t)-\cos(Roll_t)\cos(Yaw_t)\sin(Pitch_t)\\ \cos(Roll_t)\cos(Pitch_t)\end{bmatrix}$$

$Roll_t$, $Yaw_t$ and $Pitch_t$ are the angles sampled at the sampling time t by the tri-axial magnetometer.

In particular, when the predetermined ball game type is golf swing, the first dimension is a horizontal dimension, and the second dimension is a vertical dimension. Preferably, the predetermined power-assisting path early stage corresponding feature point ratio is a ratio of 4 or higher, and the predetermined motion top point corresponding feature point velocity threshold is a value of 0.1 m/s or lower. When $\alpha$ and $\beta$ are 0.5 and 0.5, the predetermined ball hitting time corresponding feature point threshold is a value of 0.1 or lower, and the predetermined ball hitting time acceleration change rate threshold is a value of 10 $m/s^2$ or higher.

When the predetermined ball game type is golf swing, the feature point recognition tactics further comprise at least one of the following recognition tactics:

Recognition tactic of feature point one: velocity being 0.

Recognition tactic of feature point three: both ratios of velocity in a first direction of the vertical dimension to velocity in the other two dimensions being larger than a predetermined feature point three ratio. The predetermined feature point three ratio can be a value of experience or an experimental value, and can be preferably a ratio of 4 or higher.

Recognition tactic of feature point five: both ratios of velocity in a second direction of the vertical dimension to velocity in the other two dimensions being larger than a predetermined feature point five ratio, in which the first direction is opposite to the second direction, and the predetermined feature point five ratio is larger than the predetermined feature point three ratio. The predetermined feature point five ratio can be a value of experience or an experimental value, and can be preferably a ratio of 8 or higher.

Recognition tactic of feature point one: velocity being 0.

Also, the motion recognizing unit 720 is configured to recognize the motion as the predetermined ball game type if the feature points extracted by the feature point extracting unit 710 satisfy predetermined sequence and number requirement; or if the feature points extracted by the feature point extracting unit 710 satisfy the predetermined sequence and grading to the motion according to predetermined weight values corresponding to the feature points extracted satisfies a predetermined grade requirement.

Preferably, due to the importance of the power-assisting path early stage corresponding feature point, the motion top point corresponding feature point, and the ball hitting time corresponding feature point, the weight values of these three feature points can be given higher such that the predetermined grade requirement can be satisfied if the power-assisting path early stage corresponding feature point, the motion top point corresponding feature point, and the ball hitting time corresponding feature point are extracted.

For a golf swing motion, the predetermined sequence is: the feature point one, the power-assisting path early stage corresponding feature point, the feature point three, the motion top point corresponding feature point, the feature point five, the ball hitting time corresponding feature point, and the feature point seven. The number requirement N is between 4 and 7.

Furthermore, a temporary standstill interval may exist in some motions. To prevent the misjudgment that the motion is at its end from occurring, if the motion recognizing unit 720 confirms that the end time $t_e$ and the original time of a next motion are between a first predetermined feature point and a second predetermined feature point, the end time $t_e$ and an original time of the next motion are ignored, and the motion and the next motion are recognized as one continuous motion, and the motion parameters between the original time $t_o$ and an end time of the next motion are confirmed as the motion.

In the golf swing motion, the first predetermined feature point is the feature point four, and the second predetermined feature point is the feature point five.

After the process shown in FIG. 5 or the apparatus in FIG. 7 recognizes a motion as the predetermined ball game type, further application can be described as follows:

(1) The motion parameters of the motion can be sent to a parameter display device (such as the parameter display device 150 in FIG. 1). The parameter display device can display the position information at each sampling time in the format of a table, or display a three-dimensional motion path of the recognized object, and/or display the velocity information at each sampling time in the format of a table or display the velocity information of the recognized object in a line chart. A user can check the detailed information of the motion of the recognized object, such as real-time velocity, position, position-time distribution, and velocity-time distribution, by the parameter display device.

Taking golf swing as the example, when a motion is recognized as a golf swing motion, the motion data of the motion can be sent to an iPhone (as the parameter display device). The iPhone can show the three-dimensional motion path of the golf swing, and the user can check the detailed information on the iPhone, such as the velocity and stance of the impact. Furthermore, the paths of multiple motions can be displayed together for the user to compare the accuracy and consistency of the motions. For example, paths of several golf swing motion can be shown together.

(2) The motion parameters of the motion can be sent to an expert evaluation device, or the information displayed on the parameter display device can be provided to the expert evaluation device for evaluation.

The expert evaluation device can be a device performing automated evaluation according to preset motion parameter database. The preset motion parameter database stores evaluation information corresponding to the motion parameters, and can provide evaluation for information such as acceleration, real-time velocity and position at each time.

The expert evaluation device can also be a user interface to provide the motion parameters to the expert for human evaluation. Preferably, the user interface can obtain the evaluation information input by the expert, and the evaluation information can be sent to a terminal device for the user to check for reference.

(3) The motion parameters of the motion can be sent to more than one terminal device, such as the iPhones of more than one users. Thus, the users of the terminal devices can share the motion parameters to create interaction.

It should be noted that, in the embodiments of the invention, the MEMS sensor device is provided as an example of the sensor device. However, the invention is not limited to the MEMS sensor device, and other sensor device can be utilized to perform sampling of the motion data in the embodiments of the invention.

The preferred embodiments of the present invention have been disclosed in the examples to show the applicable value in the related industry. However the examples should not be construed as a limitation on the actual applicable scope of the invention, and as such, all modifications and alterations without departing from the spirits of the invention and appended claims shall remain within the protected scope and claims of the invention.

What is claimed is:

1. A method of ball game motion recognition, comprising:

obtaining motion parameters corresponding to each sampling time for a motion;

extracting feature points according to predetermined feature point recognition tactics utilizing the motion parameters obtained, wherein the feature point recognition tactics comprise recognition tactics of at least three types of the feature points, comprising: power-assisting path early stage corresponding feature point, motion top point corresponding feature point, and ball hitting time corresponding feature point; and recognizing the motion as a predetermined ball game type if the feature points extracted satisfy feature point requirements of the predetermined ball game type;

wherein the recognition tactics of the power-assisting path early stage corresponding feature point comprise: both ratios of velocity in the first dimension to velocity in the other two dimensions being larger than a predetermined power-assisting path early stage corresponding feature point ratio;

the recognition tactics of the motion top point corresponding feature point comprises: velocity in a second dimension being smaller than a predetermined motion top point corresponding feature point velocity threshold; and the recognition tactics of the ball hitting time corresponding feature point comprise:

recognizing the ball hitting time corresponding feature point if, at the sampling time t, a value of $\min(\alpha\|X_t-X_{init}\|+\beta\|T_t-T_{init}\|)$ is smaller than a predetermined ball hitting time corresponding feature point threshold, wherein $\alpha$ and $\beta$ are predetermined parameters, $X_t$ is a position corresponding to the sampling time t, $X_{init}$ is a position corresponding to an original time $t_o$ of the motion, $T_t$ is a stance corresponding to the sampling time t, and $T_{init}$ is a stance corresponding to the original time $t_o$ of the motion; and recognizing the ball hitting time corresponding feature point if, at the sampling time, an acceleration change rate is larger than a predetermined ball hitting time acceleration change rate threshold.

2. The method as claimed in claim 1, wherein the motion parameters corresponding to each sampling time are obtained from motion data sampled at each of the sampling time by a sensor device;

the sensor device comprises a tri-axial accelerometer, a tri-axial gyroscope, and a tri-axial magnetometer; and the motion parameters comprise acceleration, velocity, stance and position.

3. The method as claimed in claim 1, wherein the step of obtaining motion pictures further comprises:

obtaining the motion parameters at each of the sampling time;

performing motion static detection utilizing acceleration at each of the sampling time to confirm an original time $t_o$ and an end time $t_e$ of the motion; and confirming the motion parameters from the original time $t_o$ to the end time $t_e$.

4. The method as claimed in claim 3, wherein the step of performing motion static detection further comprises:

performing judgment according to predetermined motion time confirming tactics to each of the sampling time in sequence of the sampling time, if at the sampling time to the predetermined motion time confirming tactics are satisfied and at the sampling time to−1 the predetermined motion time confirming tactics are not satisfied, confirming the sampling time $t_o$ as the original time; and if at the sampling time $t_e$ the predetermined motion time confirming tactics are satisfied and at the sampling time $t_e$+1 the predetermined motion time confirming tactics are not satisfied, confirming the sampling time $t_e$ as the end time.

5. The method as claimed in claim 4, wherein the predetermined motion time confirming tactics comprise:

confirming one of the sampling time $t_x$ as motion time if a modulated variance $a_v$ of the acceleration from a number T of the sampling time before the sampling time $t_x$ is larger than or equal to a predetermined acceleration variance threshold and a modulated acceleration $a_0$ at the sampling time $t_x$ is larger than or equal to a predetermined motion acceleration threshold, wherein the number T is a predetermined positive integer.

6. The method as claimed in claim 1, wherein, when the predetermined ball game type is golf swing:

the first dimension is a horizontal dimension, and the second dimension is a vertical dimension; and the predetermined power-assisting path early stage corresponding feature point ratio is a ratio of 4 or higher, the predetermined motion top point corresponding feature point velocity threshold is a value of 0.1 m/s or lower, the predetermined ball hitting time corresponding feature point threshold is a value of 0.1 or lower, and the predetermined ball hitting time acceleration change rate threshold is a value of 10 $m/s^2$ or higher.

7. The method as claimed in claim 1, wherein, when the predetermined ball game type is golf swing, the feature point recognition tactics further comprise at least one of:

recognition tactic of feature point one: velocity being 0;

recognition tactic of feature point three: both ratios of velocity in a first direction of a vertical dimension to velocity in the other two dimensions being larger than a predetermined feature point three ratio;

recognition tactic of feature point five: both ratios of velocity in a second direction of a vertical dimension to velocity in the other two dimensions being larger than a predetermined feature point five ratio, wherein the first direction is opposite to the second direction, and the predetermined feature point five ratio is larger than the predetermined feature point three ratio; and recognition tactic of feature point seven: velocity being 0.

8. The method as claimed in claim 7, wherein the predetermined feature point three ratio is a ratio of 4 or higher, and the predetermined feature point five ratio is a ratio of 8 or higher.

9. The method as claimed in claim 1, wherein the feature point requirements of the predetermined ball game type comprise:

the feature points extracted satisfying predetermined sequence and number requirement; and the feature points extracted satisfying the predetermined sequence, and grading to the motion according to predetermined weight values corresponding to the feature points extracted satisfying a predetermined grade requirement.

10. The method as claimed in claim 9, wherein the predetermined weight values corresponding to the power-assisting path early stage corresponding feature point, the motion top point corresponding feature point, and the ball hitting time corresponding feature point enable the grading to the motion according to the power-assisting path early stage corresponding feature point, the motion top point corresponding feature point, and the ball hitting time corresponding feature point satisfying the predetermined grade requirement.

11. The method as claimed in claim 7, wherein the feature point requirements of the predetermined ball game type comprise:

the feature points extracted satisfying predetermined sequence and number requirement; and the feature points extracted satisfying the predetermined sequence, and grading to the motion according to predetermined weight values corresponding to the feature points extracted satisfying a predetermined grade requirement;

wherein the predetermined sequence is a sequence of the feature point one, the power-assisting path early stage corresponding feature point, the feature point three, the motion top point corresponding feature point, the feature point five, the ball hitting time corresponding feature point, and the feature point seven; and the number requirement N is between 4 and 7.

12. The method as claimed in claim 3, further comprising: ignoring the end time $t_e$ and an original time of a next motion and confirming the motion parameters between the original time $t_o$ and an end time of the next motion as the motion if the end time $t_e$ and the original time of the next motion are between a first predetermined feature point and a second predetermined feature point.

13. An apparatus for ball game motion recognition, comprising:

a parameter obtaining unit to obtain motion parameters at sampling time for a motion;

a feature point extracting unit to extract feature points according to predetermined feature point recognition tactics utilizing the motion parameters, wherein the feature point recognition tactics comprises recognition tactics of at least three types of the feature points: power-assisting path early stage corresponding feature point, motion top point corresponding feature point, and ball hitting time corresponding feature point; and a motion recognizing unit to recognize the motion as a predetermined ball game type if the feature points extracted satisfy feature point requirements of the predetermined ball game type;

wherein the recognition tactics of the power-assisting path early stage corresponding feature point comprise: both ratios of velocity in the first dimension to velocity in the other two dimensions being larger than a predetermined power-assisting path early stage corresponding feature point ratio;

the recognition tactics of the motion top point corresponding feature point comprises: velocity in a second dimension being smaller than a predetermined motion top point corresponding feature point velocity threshold; and the recognition tactics of the ball hitting time corresponding feature point comprises:

recognizing the ball hitting time corresponding feature point if, at the sampling time t, a value of $\min(\alpha\|X_t-X_{init}\|+\beta\|T_t-T_{init}\|)$ is smaller than a predetermined ball hitting time corresponding feature point threshold, wherein $\alpha$ and $\beta$ are predetermined parameters, $X_t$ is a position corresponding to the sampling time t, $X_{init}$ is a position corresponding to an original time $t_o$ of the motion, $T_t$ is a stance corresponding to the sampling time t, and $T_{init}$ is a stance corresponding to the original time $t_o$ of the motion; and recognizing the ball hitting time corresponding feature point if, at the sampling time, an acceleration change rate is larger than a predetermined ball hitting time acceleration change rate threshold.

14. The apparatus as claimed in claim 13, wherein the apparatus is connected to a motion parameter confirming device;

the parameter obtaining unit is configured to obtain motion parameters corresponding to each sampling time from the motion parameter confirming device;

the motion parameter confirming device is configured to obtain motion parameters corresponding to each sampling time according to motion data sampled at each of the sampling time by a sensor device, and the motion parameters comprise acceleration, velocity, stance and position; and the sensor device comprise a tri-axial accelerometer, a tri-axial gyroscope, and a tri-axial magnetometer.

15. The apparatus as claimed in claim 13, wherein the parameter obtaining unit further comprises:

a parameter receiving subunit to obtain the motion parameters at each of the sampling time;

a static detecting subunit to perform motion static detection utilizing acceleration at each of the sampling time to confirm an original time $t_o$ and an end time $t_e$ of the motion; and a parameter extracting subunit to confirm the motion parameters from the original time $t_o$ to the end time $t_e$.

16. The apparatus as claimed in claim 15, wherein:

the static detecting subunit is configured to perform judgment according to predetermined motion time confirming tactics to each of the sampling time in sequence of the sampling time, if at the sampling time to the predetermined motion time confirming tactics are satisfied and at the sampling time to−1 the predetermined motion time confirming tactics are not satisfied, the sampling time to is confirmed as the original time; and if at the sampling time $t_e$ the predetermined motion time confirming tactics are satisfied and at the sampling time $t_e$+1 the predetermined motion time confirming tactics are not satisfied, the sampling time $t_e$ is confirmed as the end time.

17. The apparatus as claimed in claim 16, wherein the predetermined motion time confirming tactics comprise:

confirming one of the sampling time $t_x$ as motion time if a modulated variance $a_v$ of the acceleration from a number T of the sampling time before the sampling time $t_x$ is larger than or equal to a predetermined acceleration variance threshold and a modulated acceleration $a_0$ at the sampling time $t_x$ is larger than or equal to a predetermined motion acceleration threshold, wherein the number T is a predetermined positive integer.

18. The apparatus as claimed in claim 13, wherein, when the predetermined ball game type is golf swing:

the first dimension is a horizontal dimension, and the second dimension is a vertical dimension; and the predetermined power-assisting path early stage corresponding feature point ratio is a ratio of 4 or higher, the predetermined motion top point corresponding feature point velocity threshold is a value of 0.1 m/s or lower, the predetermined ball hitting time corresponding feature point threshold is a value of 0.1 or lower, and the predetermined ball hitting time acceleration change rate threshold is a value of 10 $m/s^2$ or higher.

19. The apparatus as claimed in claim 13, wherein, when the predetermined ball game type is golf swing, the feature point recognition tactics further comprise at least one of:

recognition tactic of feature point one: velocity being 0;

recognition tactic of feature point three: both ratios of velocity in a first direction of a vertical dimension to velocity in the other two dimensions being larger than a predetermined feature point three ratio;

recognition tactic of feature point five: both ratios of velocity in a second direction of a vertical dimension to velocity in the other two dimensions being larger than a predetermined feature point five ratio, wherein the first direction is opposite to the second direction, and the predetermined feature point five ratio is larger than the predetermined feature point three ratio; and recognition tactic of feature point seven: velocity being 0.

20. The apparatus as claimed in claim 19, wherein the predetermined feature point three ratio is a ratio of 4 or higher, and the predetermined feature point five ratio is a ratio of 8 or higher.

21. The apparatus as claimed in claim 13, wherein the motion recognizing unit is configured to recognize the motion as the predetermined ball game type if the feature points extracted by the feature point extracting unit satisfy predetermined sequence and number requirement; or if the feature points extracted by the feature point extracting unit satisfy the predetermined sequence and grading to the motion according to predetermined weight values corresponding to the feature points extracted satisfies a predetermined grade requirement.

22. The apparatus as claimed in claim 21, wherein the predetermined weight values corresponding to the power-assisting path early stage corresponding feature point, the motion top point corresponding feature point, and the ball hitting time corresponding feature point enable the grading to the motion according to the power-assisting path early stage corresponding feature point, the motion top point corresponding feature point, and the ball hitting time corresponding feature point satisfying the predetermined grade requirement.

23. The apparatus as claimed in claim 19, wherein the motion recognizing unit is configured to recognize the motion as golf swing if the feature points extracted by the feature point extracting unit satisfy predetermined sequence and number requirement; or if the feature points extracted by the feature point extracting unit satisfy the predetermined sequence and grading to the motion according to predetermined weight values corresponding to the feature points extracted satisfies a predetermined grade requirement;

wherein the predetermined sequence is a sequence of the feature point one, the power-assisting path early stage corresponding feature point, the feature point three, the motion top point corresponding feature point, the feature point five, the ball hitting time corresponding feature point, and the feature point seven; and the number requirement N is between 4 and 7.

24. The apparatus as claimed in claim 15, wherein, if the end time $t_e$ and the original time of the next motion are between a first predetermined feature point and a second predetermined feature point, the end time $t_e$ and an original time of a next motion are ignored and the motion parameters between the original time $t_o$ and an end time of the next motion are confirmed as the motion.

25. A motion assisting device, comprising:

an apparatus for ball game motion recognition as claimed in claim 13;

a sensor device to sample motion data of a recognized object at each of the sampling time, the motion data comprising acceleration; and a motion parameter confirming device to obtain motion parameters of the recognized object corresponding to each sampling time according to motion data sampled by the sensor device, and to send the motion parameters to the apparatus for ball game motion recognition.

26. The motion assisting device as claimed in claim 25, wherein the sensor device comprises:

a tri-axial accelerometer to sample acceleration of the recognized object;

a tri-axial gyroscope to sample angular velocity of the recognized object; and a tri-axial magnetometer to sample the angle of the recognized object corresponding to a three-dimensional geomagnetic coordinate system.

27. The motion assisting device as claimed in claim 25, further comprising:

a processor to retrieve and transmit the motion data from the sensor device to the motion parameter confirming device according to predetermined transfer protocol.

28. The motion assisting device as claimed in claim 25, further comprising:

data transmit interface to send motion parameters of the predetermined ball game type recognized by the apparatus for ball game motion recognition to a peripheral device.

* * * * *